US005635942A

United States Patent [19]

Kushihi et al.

[11] Patent Number: 5,635,942

[45] Date of Patent: Jun. 3, 1997

[54] MICROSTRIP ANTENNA

[75] Inventors: Yuichi Kushihi; Yasuaki Saitoh; Kenshi Michishita, all of Nagaokakyo, Japan

[73] Assignee: Murata Manufacturing Co., Ltd., Japan

[21] Appl. No.: 327,986

[22] Filed: Oct. 24, 1994

[30] Foreign Application Priority Data

Oct. 28, 1993 [JP] Japan ..... 5-270730

[51] Int. Cl.[6] ..... H01Q 1/38; H01Q 23/00

[52] U.S. Cl. ..... 343/700 MS; 343/906

[58] Field of Search ..... 343/700 MS, 906, 343/702; H01Q 1/38, 23/00

[56] References Cited

U.S. PATENT DOCUMENTS 4,994,820 2/1991 Suzuki et al. ..... 343/700 MS
5,386,214 1/1995 Sugawara ..... 343/700 MS
5,402,136 3/1995 Goto et al. ..... 343/700 MS
5,448,249 9/1995 Kushihi et al. ..... 343/700 MS

*Primary Examiner*—Michael C. Wimer
*Attorney, Agent, or Firm*—Ostrolenk, Faber, Gerb & Soffen, LLP

[57] ABSTRACT

A microstrip antenna (4) has a radiation electrode (2) and a ground electrode (3) which are formed on upper and lower surfaces of a dielectric substrate (1) respectively. A feeding terminal electrode (2*c*) of the radiation electrode (2) is formed on the lower surface of the dielectric substrate (1), which is provided with the ground electrode (3), and is insulated from the ground electrode (3). A feeding point (2*a*) of the radiation electrode (2) is connected with the feeding terminal electrode (2*c*) by a through-hole electrode (2*b*). The feeding terminal electrode (2*c*) is formed in the same plane as the ground electrode (3). In another embodiment of the invention, a through-hole electrode (12*b*) extends from a feeding point (12*a*) to the plane of the ground electrode (13).

3 Claims, 4 Drawing Sheets

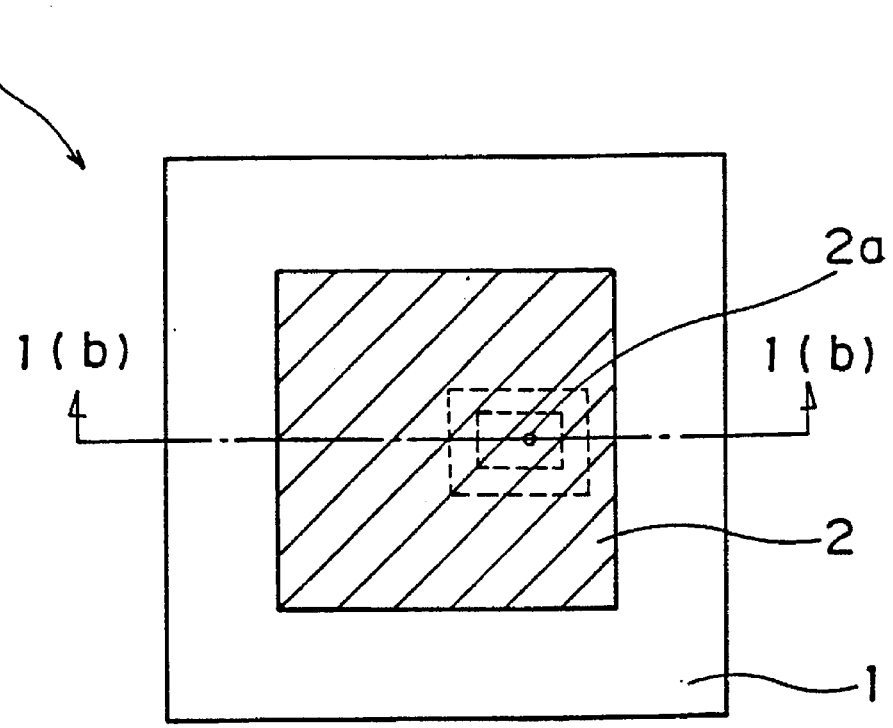
FIG. 1 ( a )
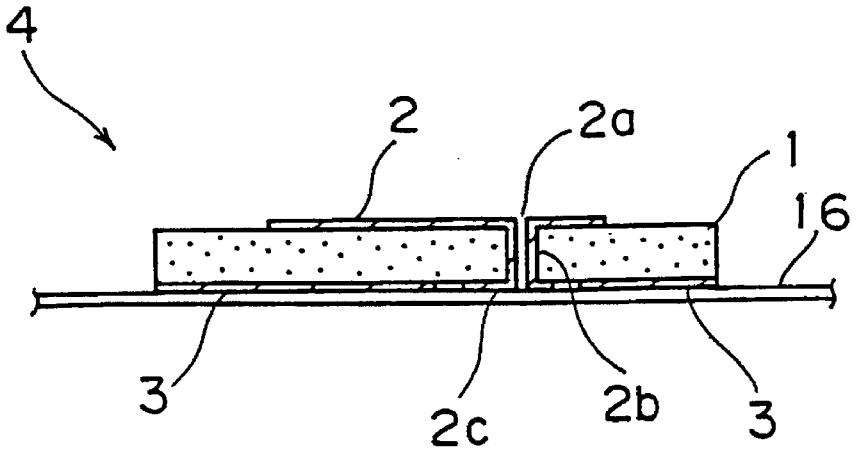
FIG. 1 ( b )

FIG. 3(a) PRIOR ART
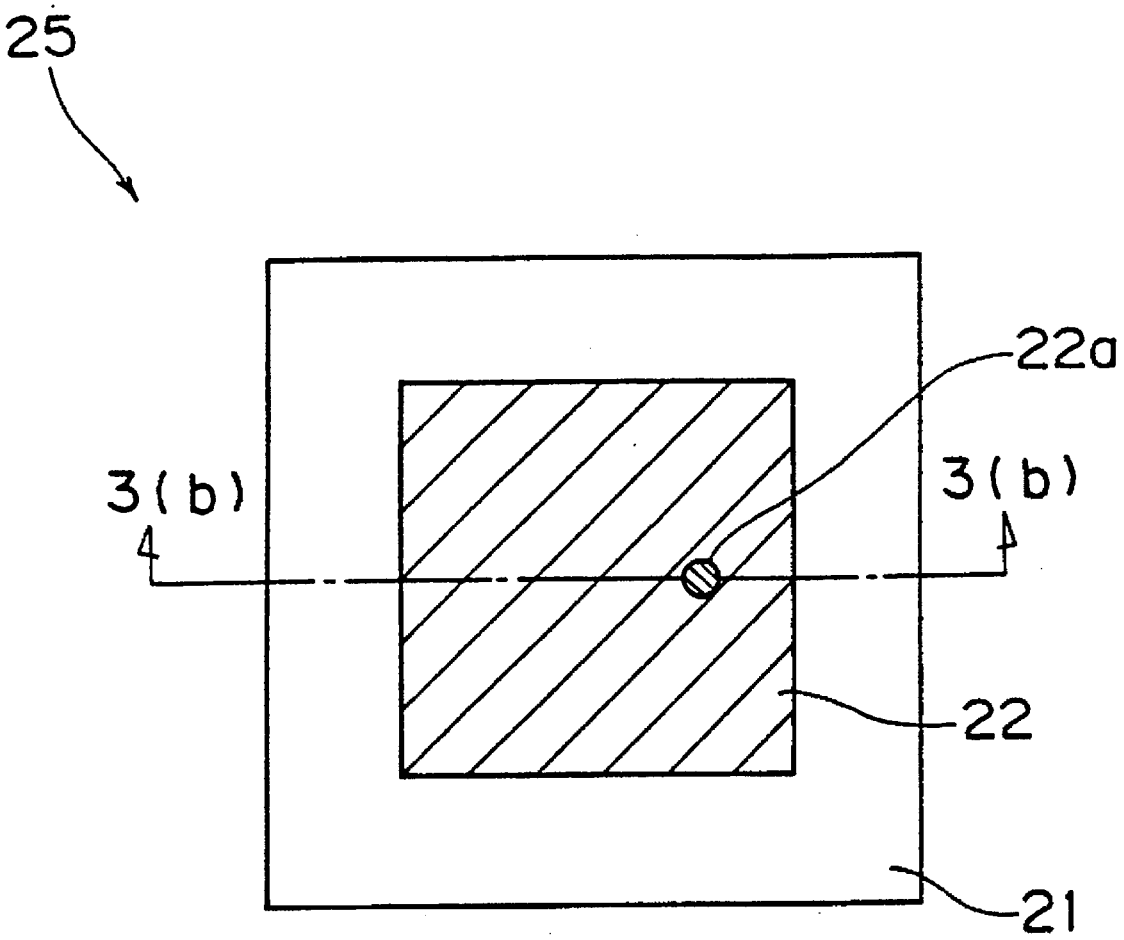
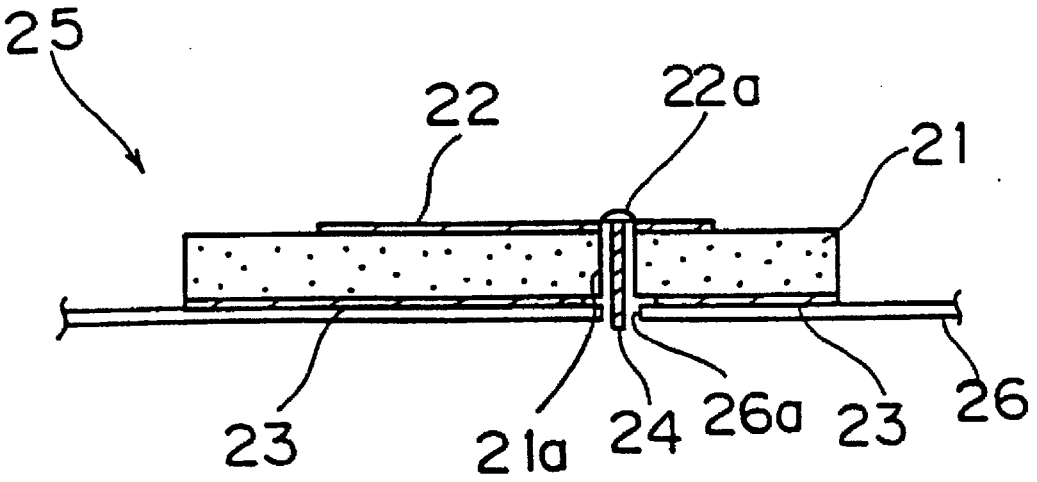
FIG. 3(b) PRIOR ART

FIG. 4(a) PRIOR ART
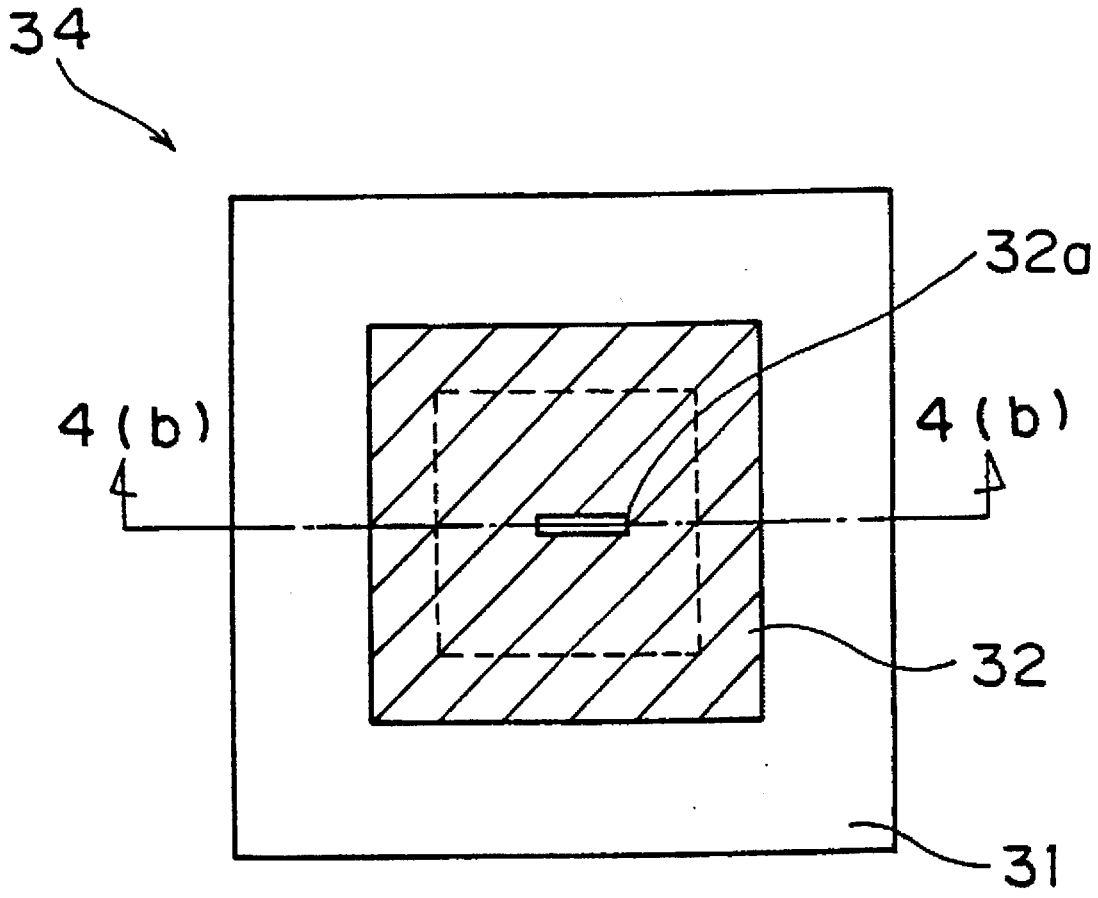
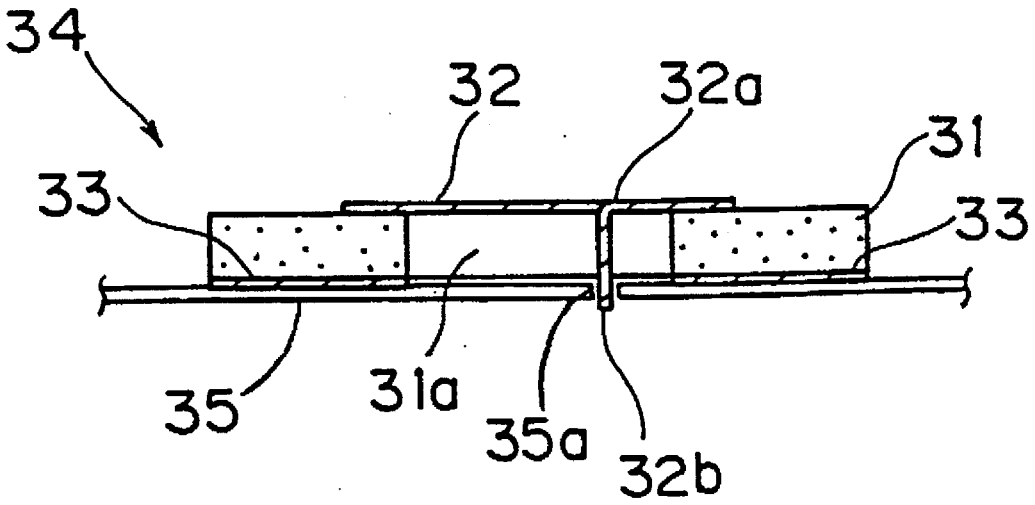
FIG. 4(b) PRIOR ART

MICROSTRIP ANTENNA

BACKGROUND OF THE INVENTION

1. Field of the Invention

The present invention relates to the structure of a microstrip antenna, which is for use in a mobile communication device or a GPS (global positioning system) device.

2. Description of the Background Art

FIGS. 3(*a*) and 3(*b*) are structural diagrams showing an exemplary conventional microstrip antenna 25. Referring to FIGS. 3(*a*) and 3(*b*), the microstrip antenna 25 has a dielectric substrate 21, and a radiation electrode 22 and a ground electrode 23 which are formed on upper and lower surfaces of the dielectric substrate 21 respectively. The radiation electrode 22 is provided in the form of a rectangle, which is smaller in outline than the dielectric substrate 21. A feeder 24 is connected to a feeding point 22*a* of the radiation electrode 22 by soldering. The feeder 24 downwardly projects from the lower surface of the dielectric substrate 21, through a through hole 21*a* which is formed in the dielectric substrate 21 from the feeding point 22*a* of the radiation electrode 22. The ground electrode 23, which is formed to substantially cover the overall lower surface of the dielectric substrate 21, is notched in a portion around the forward end of the feeder 24.

This microstrip antenna 25 is mounted on a printed circuit board 26 so that the ground electrode 23 is in contact with a surface of the printed circuit board 26. At this time, the forward end of the feeder 24 is inserted in a small hole 26*a* which is formed in the printed circuit board 26, to project from a back surface of the printed circuit board 26. The ground electrode 23 is soldered to a circuit pattern which is provided on the printed board 26, while the forward end of the feeder 24 is soldered to another circuit pattern which is provided on the back surface of the printed circuit board 26.

FIGS. 4(*a*) and 4(*b*) are structural diagrams showing another exemplary conventional microstrip antenna 34. This microstrip antenna 34 comprises a dielectric substrate 31 having an opening portion 31*a* in its center. A radiation electrode 32 is formed on an upper surface of the dielectric substrate 31, to cover the opening portion 31*a*. A ground electrode 33 is formed on a nearly overall back surface of the dielectric substrate 31, excluding the opening portion 31*a*. The radiation electrode 32 is partially downwardly bent to define a feeding terminal 32*b*. This feeding terminal 32*b* passes through the opening portion 31*a* of the dielectric substrate 31 from a feeding point 32*a* of the radiation electrode 32, to project from a surface of the ground electrode 33.

Similarly to the microstrip antenna 25 shown in FIGS. 3(*a*) and 3(*b*), the ground electrode 33 of the microstrip antenna 34 is soldered to a circuit pattern which is provided on a surface of a printed circuit board 35, while the forward end of the feeding terminal 32*b* is inserted into a small hole 35*a* formed in the printed circuit board 35 and is soldered to another circuit pattern which is formed on a back surface of the printed circuit board 35.

Thus, each of the aforementioned conventional microstrip antennas 25 and 34 requires the feeder 24 or the feeding terminal 32*b* projecting from the back surface of the printed circuit board 26 or 35, in order to connect the radiation electrode 22 or 32 with the printed circuit board 26 or 35. Therefore, it is necessary to form the small hole 26*a* or 35*a* in the printed circuit board 26 or 35, for passing the feeder 24 or the feeding terminal 32*b* therethrough. Further, two steps are required for soldering the ground electrode 23 or 33 and the feeder 24 or the feeding terminal 32*b* to the circuit patterns which are provided on the front and back surfaces of the printed circuit board 26 or 35 respectively. Thus, the steps of mounting the microstrip antenna 25 or 34 on the printed circuit board 26 or 35 are disadvantageously complicated.

SUMMARY OF THE INVENTION

An object of the present invention is to provide a microstrip antenna, which can simplify a step of mounting the antenna on a surface of a printed circuit board.

The microstrip antenna according to the present invention comprises a dielectric substrate having a first major surface and a second major surface which is opposite thereto, a ground electrode which is formed on the first major surface of the dielectric substrate, a radiation electrode which is formed on the second major surface, and a feeding terminal electrode. The feeding terminal electrode extends from a feeding point provided on the radiation electrode toward the first major surface through the dielectric substrate, so that its forward end portion is formed in a plane including the ground electrode while being insulated from the ground electrode.

Due to the aforementioned structure, both of the ground electrode and an end of the radiation electrode are located on a mounting surface side of the microstrip antenna and included in the same plane. Thus, the ground electrode and the radiation electrode are connected to respective circuit patterns which are provided on the same surface of a printed circuit board, for example, through a single soldering step.

According to a limited aspect of the present invention, the feeding terminal electrode has a forward end portion which is formed on the first major surface of the dielectric substrate, and a through-hole electrode which is formed in a through hole formed in the dielectric substrate for connecting the forward end portion with the feeding point of the radiation electrode.

According to another limited aspect of the present invention, the dielectric substrate has an opening portion in a region which is covered with the radiation electrode, while the feeding terminal electrode has a bent portion which is defined by partially bending the radiation electrode into the opening portion, and a forward end portion which is defined by further bending the forward end of the bent portion to be included in the same plane as the ground electrode.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1(*a*) is a plan view showing a microstrip antenna according to a first embodiment of the present invention, and FIG. 1(*b*) is a sectional view taken along the line A—A in FIG. 1(*a*);

FIG. 3(*a*) is a plan view showing an exemplary conventional microstrip antenna, and FIG. 3(*b*) is a sectional view taken along the line C—C in FIG. 3(*a*); and FIG. 4(*a*) is a plan view showing another exemplary conventional microstrip antenna, and FIG. 4(*b*) is a sectional view taken along the line D—D in FIG. 4(*a*).

DESCRIPTION OF THE PREFERRED EMBODIMENTS

Figure 2A:
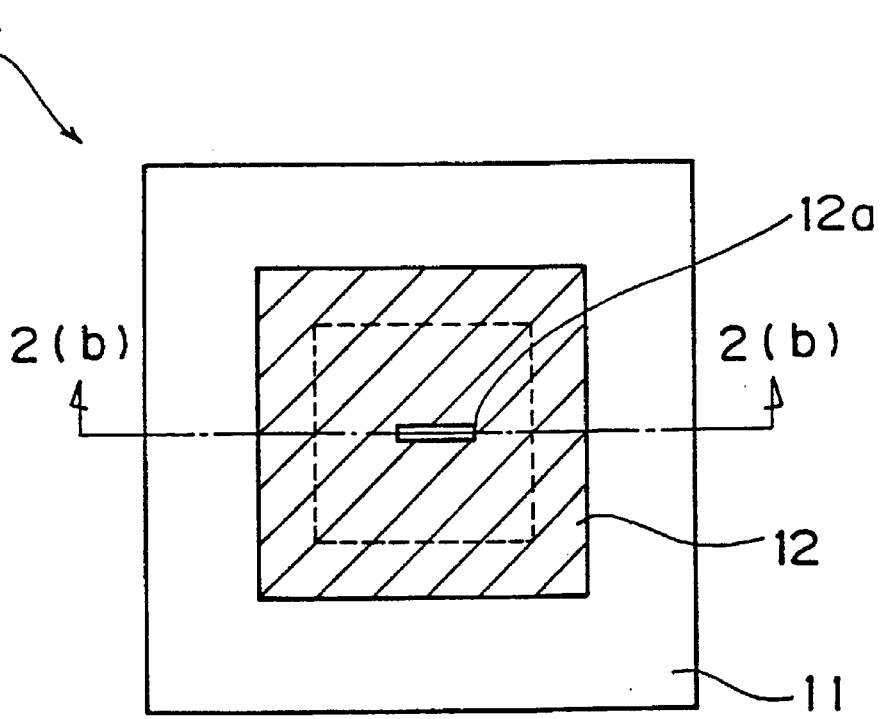
FIG. 2(*a*) is a plan view showing a microstrip antenna according to a second embodiment of the present invention, and FIG. 2(*b*) is a sectional view taken along the line B—B in FIG. 2(*a*)

Preferred embodiments of the present invention are now described with reference to the drawings.

First Embodiment

Referring to FIGS. 1(*a*) and 1(*b*), a microstrip antenna 4 comprises a dielectric substrate 1, a radiation electrode 2 and a ground electrode 3. The dielectric substrate 1 is provided in the form of a rectangular thin plate. The rectangular radiation electrode 2 which is smaller in outline than the dielectric substrate 1 is formed on an upper surface of the dielectric substrate 1. A feeding terminal electrode 2*c* is formed on a lower surface of the dielectric substrate 1, in a position corresponding to a feeding point 2*a* which is located at a constant distance from the center of the radiation electrode 2. The feeding terminal electrode 2*c* is connected to the feeding point 2*a* of the radiation electrode 2 through a through-hole electrode 2*b*.

The ground electrode 3 is formed substantially over the entire lower surface of the dielectric substrate 1, with a notch formed around the feeding terminal electrode 2*c*. Thus, the ground electrode 3 is insulated from the feeding terminal electrode 2*c*.

In this microstrip antenna 4, both of the ground electrode 3 and the feeding terminal electrode 2*c* of the radiation electrode 2 are formed on the back surface of the dielectric substrate 1, so that surfaces thereof are flush with each other. Therefore, the microstrip antenna 4 can be placed on a surface of a printed circuit board 16 as such. Further, it is possible to simultaneously carry out interconnection and fixation on the surface of the printed circuit board 16 through a single step by employing reflow soldering or the like. Thus, it is not necessary to carry out steps of connecting the ground electrode and the feeding terminal of the radiation electrode independently of each other dissimilarly to the steps of mounting the conventional microstrip antenna, whereby the mounting step can be simplified.

Second Embodiment

Figure 2B:
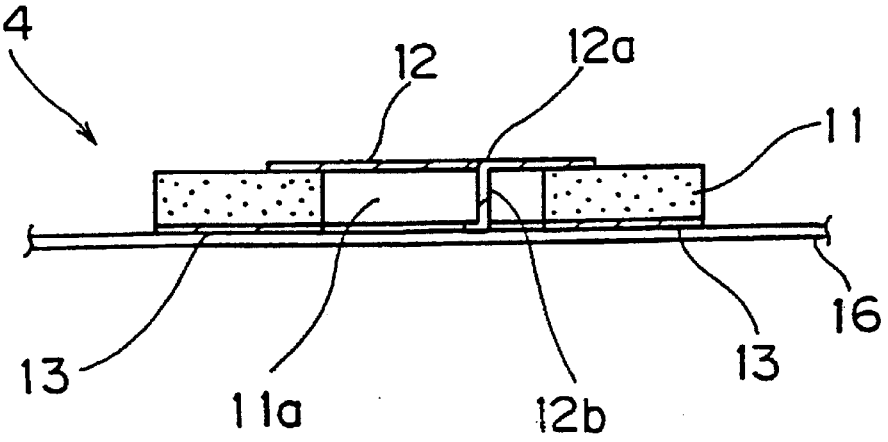

FIGS. 2(*a*) and 2(*b*) show a microstrip antenna 14, which has an opening portion 11*a* in a central portion of a dielectric substrate 11. A radiation electrode 12 which is formed by a metal plate is mounted on an upper surface of the dielectric substrate 11, to cover this opening portion 11*a*. A feeding terminal 12*b* is formed by cutting and downwardly bending a part of the radiation electrode 12 in the form of a strip. A starting point of this feeding terminal 12*b* is located in a position for forming a feeding point 12*a* which is at a constant distance from a central position of the radiation electrode 12. Further, a forward end portion of the feeding terminal 12*b* is bent to be flush with a ground electrode 13. In the aforementioned structure, the ground electrode 13 and the forward end portion of the feeding terminal 12*b* of the radiation electrode 12 are formed in the same plane, whereby the microstrip antenna 14 can be mounted on the same surface of a printed circuit board 16, similarly to the first embodiment shown in FIGS. 1(*a*) and 1(*b*). Further, it is possible to carry out steps of connecting the ground electrode 13 and the feeding terminal 12*b* of the radiation electrode 12 through a single reflow soldering step or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microstrip antenna comprising:

a dielectric substrate having a first major surface and a second major surface which is opposite to said first major surface;

a ground electrode on said first major surface of said dielectric substrate;

a radiation electrode on said second major surface of said dielectric substrate; and a feeding terminal electrode extending from a feeding point on said radiation electrode toward said first major surface through the inside of said dielectric substrate, a forward end portion of said feeding terminal electrode being formed so as to terminate substantially at a plane including said ground electrode while being insulated from said ground electrode;

and further wherein said dielectric substrate has an opening portion in a region covered with said radiation electrode, said feeding terminal electrode having a bent portion defined by partially bending said radiation electrode into said opening portion, and said forward end portion being defined by further bending a forward end of said bent portion to be included in said plane including said ground electrode.

2. A microstrip antenna in accordance with claim 1, in combination With a printed circuit board, said microstrip antenna being mounted on said printed circuit board with said first major surface of said dielectric substrate being directed toward said printed circuit board.

3. A microstrip antenna in accordance with claim 2, wherein said ground electrode and said forward end portion of said feeding terminal electrode are both conductively connected to circuit patterns on a surface of said printed circuit board adjacent to said first major surface of said dielectric substrate.

* * * * *